US005815955A

United States Patent [19]

Wu

[11] Patent Number: 5,815,955

[45] Date of Patent: Oct. 6, 1998

[54] LUMINOUS SAFETY DEVICE FOR FOOTWEAR

[76] Inventor: Andy Wu, No. 10, Lane 139, Sec. 1, Chain-Pin Rd., Taichung, Taiwan

[21] Appl. No.: 897,623

[22] Filed: Jul. 21, 1997

[51] Int. Cl.[6] ..... A43B 23/00

[52] U.S. Cl. ..... 36/137; 362/103

[58] Field of Search ..... 36/137; 362/103; 315/76

[56] References Cited

U.S. PATENT DOCUMENTS

| | | | |
|---|---|---|---|
| 5,303,131 | 4/1994 | Wu | 362/103 |
| 5,357,697 | 10/1994 | Lin | 36/137 |
| 5,406,724 | 4/1995 | Lin | 36/137 |
| 5,490,338 | 2/1996 | Hwang et al. | 36/137 |

*Primary Examiner*—Robert J. Pascal
*Assistant Examiner*—Wilson Lee
*Attorney, Agent, or Firm*—Browdy and Neimark

[57] ABSTRACT

A light-emitting safety device is embedded in the transparent heel of shoe and is composed of a base, a circuit board housed in a receiving space of the base, and a deformable cap engaged with the base. The circuit board is composed of a light-emitting body, a control integrated circuit, a battery, and two connection points. The cap is provided with a conductive member capable of connecting the two connection points so as to trigger the control integrated circuit to make the power supply available to the light-emitting body when the cap is deformed by the pressure of a foot wearing the shoe. As soon as the cap is relieved of the pressure of the foot, the cap is capable of recovering its original form such that the conductive member disengages the two connection points, thereby resulting in the interruption of the power supply to the light-emitting body.

6 Claims, 2 Drawing Sheets

LUMINOUS SAFETY DEVICE FOR FOOTWEAR

FIELD OF THE INVENTION

The present invention relates generally to a luminous safety device, and more particularly to a luminous safety device intended for use in shoes.

BACKGROUND OF THE INVENTION

The conventional luminous safety device for shoes is generally composed of a case made of a rigid plastic material for housing a circuit board and a switching apparatus. The circuit board comprises a control IC, a battery, and a plurality of luminous bodies. The safety device is embedded in the heel of a shoe such that the safety device is triggered by the pressure of a foot wearing the shoe.

Such a conventional light-emitting device as described above is defective in design in that it is incapable of absorbing shock so as to afford a wearing comfort, and that it is not waterproof.

SUMMARY OF THE INVENTION

It is therefore the primary objective of the present invention to provide a shoe with a luminous safety device capable of absorbing shock.

It is another objective of the present invention to provide a shoe with a waterproof light-emitting safety device.

In keeping with the principle of the present invention, the foregoing objectives of the present invention are attained by a luminous safety device, which is composed of a base, a circuit board, and a deformable cap. The base comprises a locating portion and a receiving space for housing the circuit board. The base is secured in the heel of a shoe such that the safety device is triggered to emit light when the cap is deformed by the pressure of a foot wearing the shoe. The circuit board is provided with a light-emitting body, a control integrated circuit, and a battery. The cap is provided with a conductive member capable of connecting two conduction points located on the circuit board when the cap is deformed.

DETAILED DESCRIPTION OF THE INVENTION

Figure 1:
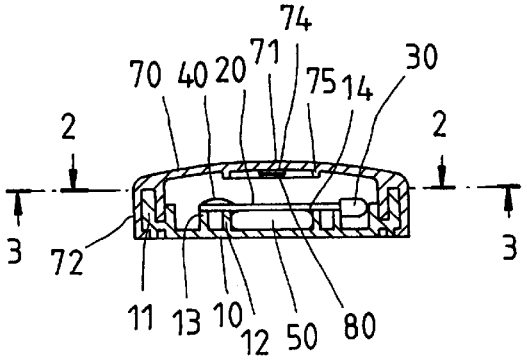
FIG. 1 shows a schematic view of an embodiment of the present invention.
Figure 2:
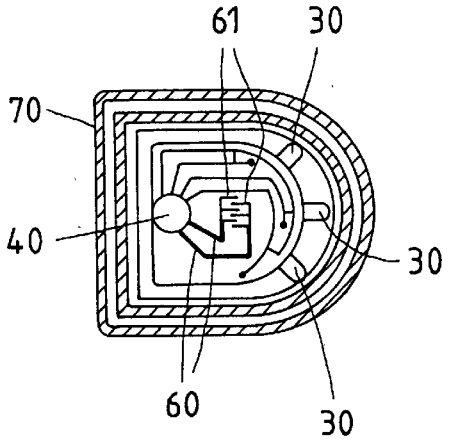
FIG. 2 shows a sectional view of a portion taken along a line 2—2 as shown in FIG. 1.
Figure 3:
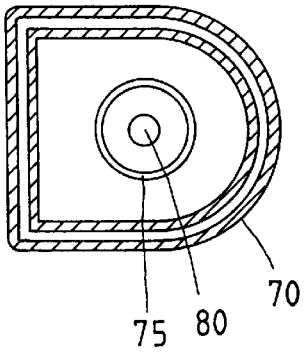
FIG. 3 shows a sectional view of a portion taken along a line 3—3 as shown in FIG. 1.
Figure 4:
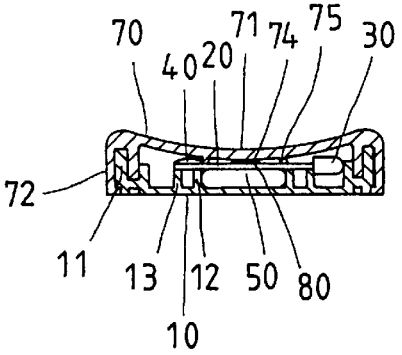
FIG. 4 shows a schematic view of the present invention at work.

As shown in all drawings provided herewith, a luminous safety device of the present invention is intended for use in a shoe and is composed of the components described hereinafter.

A base 10 is made of a transparent plastic material and is provided peripherally with an insertion portion 11. The base 10 is further provided in the middle thereof with two concentric projections 12 and 13, and a receiving space 14 defined by the two concentric projections 12 and 13.

A circuit board 20 is mounted on the concentric projections 12 and 13 of the base 10 and is provided with three light-emitting diodes 30, a control integrated circuit 40 in communication with the light-emitting bodies 30, a lithium battery 50 fastened with the underside of the circuit board 20 as a power source for the light-emitting diodes 30.

Two wires 60 are connected respectively at one end thereof with two connection points 61 located on the circuit board 20 such that the connection points 61 are not in communication with each other.

A cap 70 is made of an elastic transparent material and is composed of a top portion 71 and a ring portion 72 extending from the periphery of the top portion 71. The cap 70 is engaged with the base 10 such that the ring portion 72 is engaged with the insertion portion 11 of the base 10 in a waterproof manner, and that the circuit board 20, the light-emitting diodes 30, the control IC 40, the battery 50, and the wires 60 are all located between the base 10 and the cap 70. The top portion 71 of the cap 70 is deformable by a pressure exerting thereon and capable of recovering its original shape after being relieved of the pressure. The top portion 71 has a base portion 74, which is provided with a protruded portion 75 greater in height than the base portion 74.

A conductive member 80 is made of a conductive silicon plastic material or a conductive metal material and is located on the base portion 74 of the cap 70 such that the conductive member 80 is capable of making contact with the two connection points 61 at such time when the top portion 71 of the cap 70 is deformed by the pressure of a person's foot wearing the shoe. As soon as the two connection points 61 are connected by the conductive member 80, the control IC 40 is triggered such that the power is made available to the light-emitting diodes 30.

Figure 5:
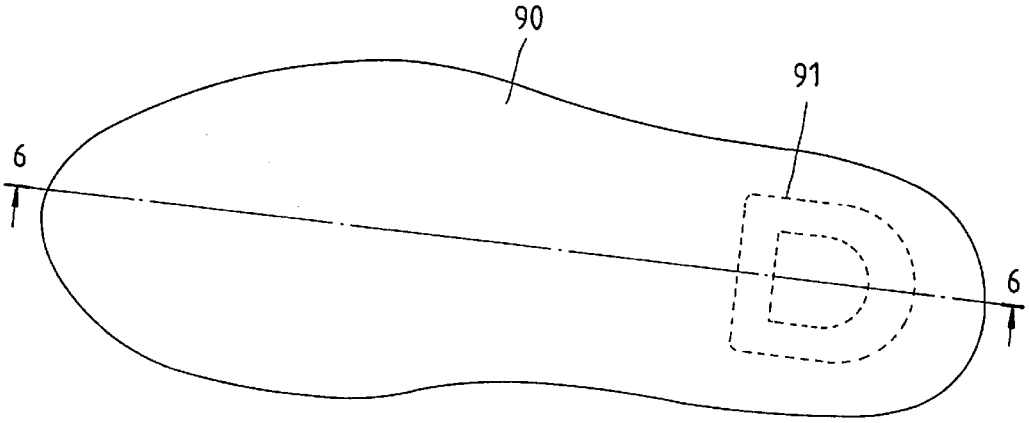
FIG. 5 shows another schematic view of the present invention at work.
Figure 6:
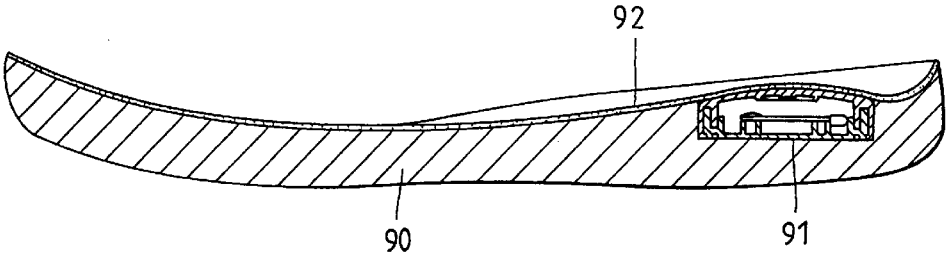
FIG. 6 shows a sectional view of a portion taken along a line 6—6 as shown in FIG. 5.

As illustrated in FIGS. 5 and 6, the device of the present invention is designed to fit into a cavity 91 of a shoe heel 90 which is made of a material pervious to light. The top portion 71 of the cap 70 is in an intimate contact with a shoe pad 92 such that the top portion 71 is caused to deform by a pressure exerting on the heel portion of the shoe pad 92. The elastic material of the cap 70 is capable of absorbing shock. In addition, there is air between the cap 70 and the base 10 to mitigate the shock. As a result, the device of the present invention does not undermine the wearing comfort of a shoe. The device of the present invention is waterproof so that the electronic components of the device are well protected to prolong the service life span of the device.

Figure 7:
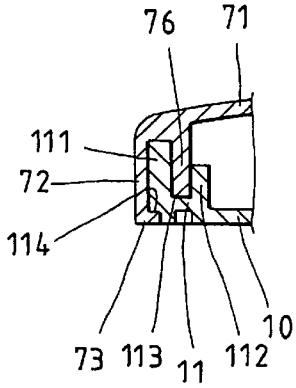
FIG. 7 shows a partial enlarged view of another embodiment of the present invention.

As shown in FIG. 7, the device of the present invention is modified such that the insertion portion 11 of the base 10 is provided with two parallel walls 111 and 112, a slot 113 located between the two walls 111 and 112, and a recess 114 located under the wall 111. In addition, the ring portion 72 of the cap 70 is provided with a shoulder 73 extending inwards from the bottom thereof such that the shoulder 73 can be fitted into the recess 114. An arm 76 is extended from the portion contiguous to the top portion 71 such that the arm 76 can be fitted into the slot 113. Such structural modifications as described above can serve the purpose of allowing the cap 70 to be opened to facilitate the replacing of the battery 50, as well as the waterproof association of the cap 70 with the base 10.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A light-emitting device for a footwear, said light-emitting device comprising:

a base made of a material pervious to light and dimensioned to fit securely into a cavity located in a transparent heel of a footwear, said base provided in a periphery thereof with an insertion portion and in a middle portion thereof with a plurality of projections and a receiving space defined by said projections;

a circuit board mounted on said projections of said base;

at least one light-emitting body mounted on said circuit board;

a control integrated circuit mounted on said circuit board for controlling power supply to said light-emitting body;

a battery mounted on said circuit board such that said battery is received in said receiving space of said base, and that said battery is connected with said control integrated circuit;

two wires each having one end which is connected with said control integrated circuit, each of said two wires further having another end which is connected with two connection points located at an interval on said circuit board;

a cap made of an elastic material pervious to light and provided with a top portion and a ring portion extending from a periphery of said top portion and engageable with said insertion portion of said base in a waterproof manner; and a conductive member fastened with said cap such that said conductive member is capable of making contact with said two connection points at such time when said top portion of said cap is deformed by a pressure exerting on the transparent heel of the footwear, thereby triggering said control integrated circuit to make power source of said battery available to said light-emitting body, said conductive member being capable of disconnecting said two connection points at such time when the transparent heel of the footwear is relieved of the pressure exerting thereon, thereby triggering said control integrated circuit to interrupt the supply of the power source of said battery to said light-emitting body.

2. The light-emitting device as defined in claim 1, wherein said light-emitting body is a light-emitting diode (LED).

3. The light-emitting device as defined in claim 1, wherein said battery is a lithium battery.

4. The light-emitting device as defined in claim 1, wherein said top portion of said cap has a base portion corresponding in location to said two connection points; and wherein said conductive member is mounted on said base portion of said cap.

5. The light-emitting device as defined in claim 1, wherein said conductive member is made of a conductive silicon plastic material or a conductive metal material.

6. The light-emitting device as defined in claim 1, wherein said insertion portion of said base is provided with two parallel walls, a slot located between said two parallel walls, and a recess located under one of said two parallel walls; and wherein said cap is provided with a ring portion having a shoulder capable of being retained in said recess of said insertion portion of aid base, said cap further provided with an arm contiguous to said top portion and capable of being retained in said slot of said insertion portion of said base.

* * * * *